US006206000B1

(12) United States Patent
Folsom

(10) Patent No.: US 6,206,000 B1
(45) Date of Patent: Mar. 27, 2001

(54) CANINE SCUBA DIVING APPARATUS

(76) Inventor: Dwane L. Folsom, 3885 S. Lake Dr., Boynton Beach, FL (US) 33435

( * ) Notice: Subject to any disclaimer, the term of this patent is extended or adjusted under 35 U.S.C. 154(b) by 0 days.

(21) Appl. No.: 08/846,628

(22) Filed: Apr. 30, 1997

(51) Int. Cl.[7] ..... B63C 11/02

(52) U.S. Cl. ..... 128/201.27; 128/201.28; 128/201.29; 128/200.29

(58) Field of Search ..... 128/201.27, 201.28, 128/200.29, 201.17, 201.22, 201.24, 201.29, 202.15, 202.14, 204.26; 2/424

(56) References Cited

U.S. PATENT DOCUMENTS

| | | | | |
|---|---|---|---|---|
| 1,689,079 | * | 10/1928 | Murakami | 128/201.27 |
| 2,113,779 | * | 4/1938 | Williamson . | |
| 2,238,759 | * | 4/1941 | Vestrem | 128/201.27 |
| 2,569,451 | * | 10/1951 | Browne | 128/201.27 |
| 3,246,350 | * | 4/1966 | Pollmann . | |
| 3,292,618 | * | 12/1966 | Davis et al. | 128/201.27 |
| 3,307,540 | * | 3/1967 | Link | 128/201.29 |
| 3,433,222 | * | 3/1969 | Pinto | 128/204.26 |
| 3,680,556 | * | 8/1972 | Morgan | 128/201.27 |
| 3,735,598 | * | 5/1973 | Oeland, Jr. | 61/70 |
| 3,880,157 | * | 4/1975 | Elifritz . | |
| 4,015,294 | * | 4/1977 | O'Neill | 2/2.1 R |
| 4,527,657 | * | 7/1985 | Payne | 128/201.19 |
| 5,678,542 | * | 10/1997 | Maffatone | 128/205.24 |

OTHER PUBLICATIONS

Videotape Titled "Shadow and Dive Equip."

* cited by examiner

*Primary Examiner*—John G. Weiss
*Assistant Examiner*—V. Srivastava
(74) *Attorney, Agent, or Firm*—Niro, Scavone, Haller & Niro

(57) ABSTRACT

The invention is a special modified scuba diving apparatus intended for use by an animal, and more specifically the famous diving dog "Shadow." The invention includes a helmet, a harness for supporting the helmet and a source of breathable gas, a special regulator providing a supply of breathable gas to the interior of the helmet, an exhaust for withdrawing exhaled air and residue water from the helmet without depressurizing the helmet, and a system of weights to compensate for the buoyancy of the user, and to counteract a net moment created about the center of buoyancy. The breathing system includes a muffler. An intercom system for providing voice instructions to Shadow can also be included.

8 Claims, 3 Drawing Sheets

CANINE SCUBA DIVING APPARATUS

BACKGROUND OF THE INVENTION

The present invention relates to a diving apparatus for a user that cannot operate a conventional diving apparatus, including animals. The invention has been employed with an animal, the wellknown diving dog, Shadow. Shadow, being a canine, cannot communicate with her owner and handler, Dwane Folsom, and is unable to operate a scuba apparatus herself.

Accordingly, the present invention provides a means for Shadow to dive both in swimming pools and the open ocean. Shadow has accomplished numerous dives in pools and in the Carribean Sea around Grand Cayman, British West Indies. She has appeared on approximately thirty television programs or news reports, many of them broadcast nationwide, such as CBS's morning news and ABC's "Good Morning America," and is a highly experienced diver.

SUMMARY OF THE INVENTION

According to the invention, there is provided a helmet that has an opening for the user's neck. The helmet includes a regulator mounted on, its external surface. The regulator is made from a conventional scuba demand regulator, but is specially modified. A muffler is provided to reduce or eliminate air noise. The helmet can be equipped with an intercom system, and can receive a weight to compensate for the user's buoyancy and any net moment about the user's center of buoyancy. The helmet is attached to a harness that supports the helmet and a tank of air or other breathable gas. The harness also receives compensating weights.

DETAILED DESCRIPTION OF THE INVENTION

Figure 1:
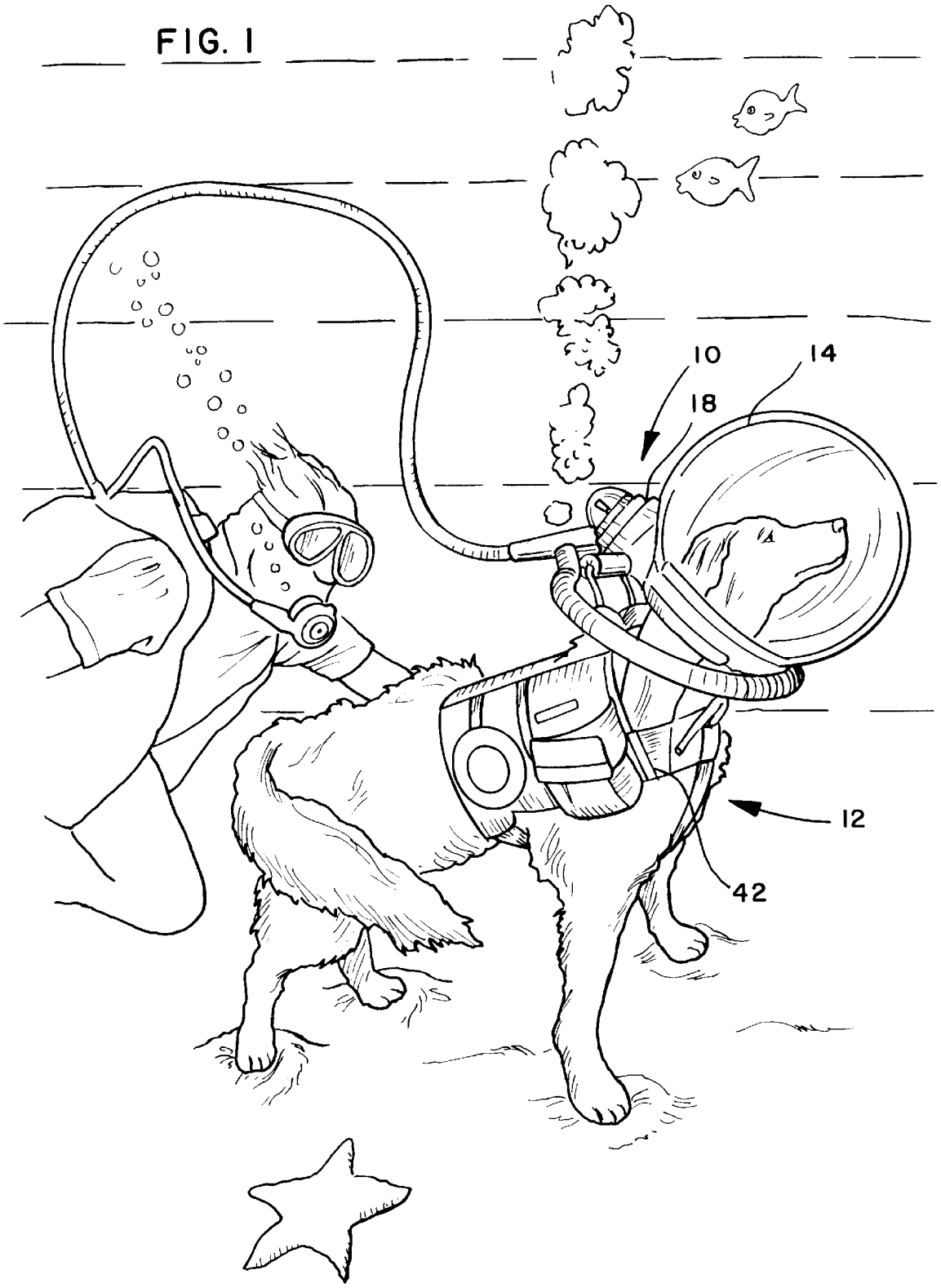
FIG. 1 is a drawing of Shadow wearing her scuba apparatus.
Figure 2:
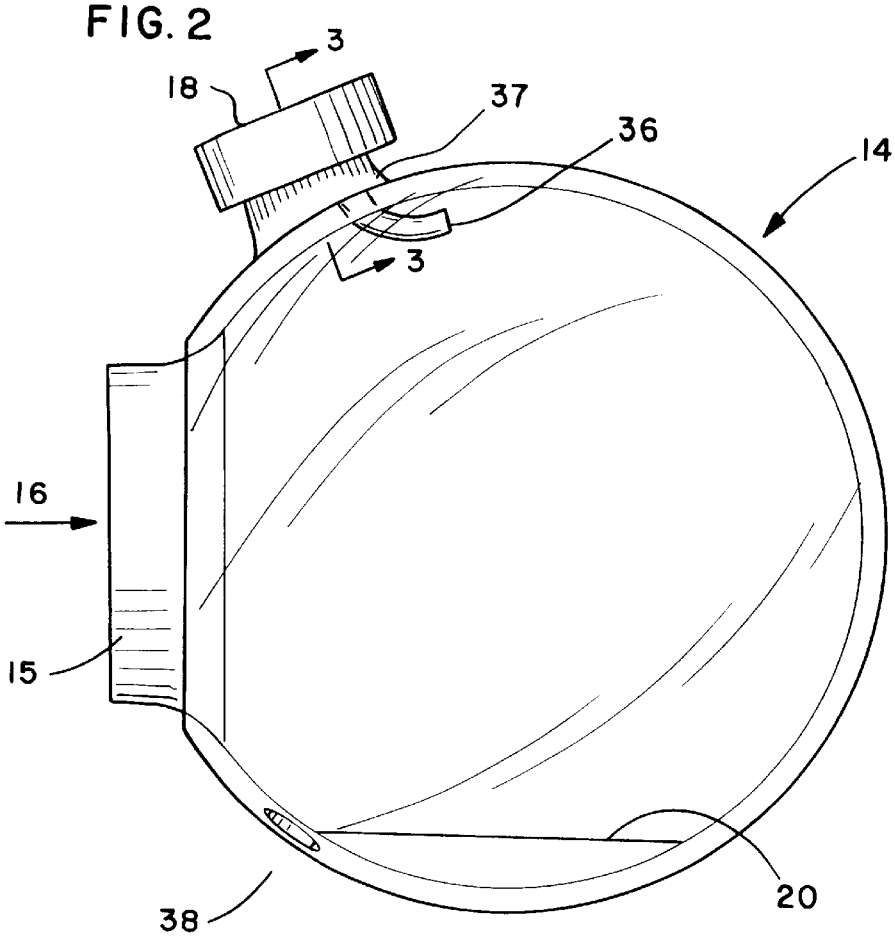
FIG. 2 is a drawing of the helmet used with the Scuba apparatus.

A scuba apparatus 10 is shown being worn by Shadow 12 in FIG. 1. Referring to FIGS. 1 and 2, the apparatus 10 includes a helmet 14 worn by Shadow. Helmet 14 is spherical and made of any suitable plastic material. Helmet 14 is preferably large enough to hold a reasonable volume of air and avoid contact with the user's head and nose, but not any larger since increased helmet volume adds to the user's buoyancy. Also, helmet 14 tends to create a significant moment because the buoyancy of helmet 14 is at one end of Shadow's body, and well away from its center of buoyancy. Helmet 14 is preferably UV-stabilized so that it will not lose its transparency. In Shadow's case, helmet 14 is approximately 10½ inches in diameter.

Helmet 14 includes an opening 16 the interior of which is lined with a skirt 15 of any non-abrasive, water-resistant material. In Shadow's case, Naugahyde® material has proved suitable. The skirt 15 seals the helmet 14 to a harness 42, described below, and therefore assists in creating a slight back pressure in helmet 14. Skirt 15 also cushions the helmet and prevents abrasion to Shadow's neck. Helmet 14 also includes a regulator 18, a compensating weight 20, and an intercom system 22.

Compensating weight 20 must be adjusted for the particular user, and for changes from salt to fresh water. In Shadow's case, weight 20 is approximately four to six pounds. Less weight is required in fresh water than in salt water. More weight can be used to insure that all four of Shadow's feet contact the bottom, or to enable her to lie on the bottom or enable her to perform certain movements or positions she has been trained to use upon signals from her handler, Dwane Folsom.

The bottom surface of weight 20 is hemispherical to fit the bottom of helmet 20. Weight 20 is anchored to helmet 14 by some means 20*a* that allows the weight to be removed if necessary, for example, when Shadow dives in a fresh water pool instead of the ocean. In the present embodiment, Velcro® 20*a* material has proven useful and convenient.

Figure 3:
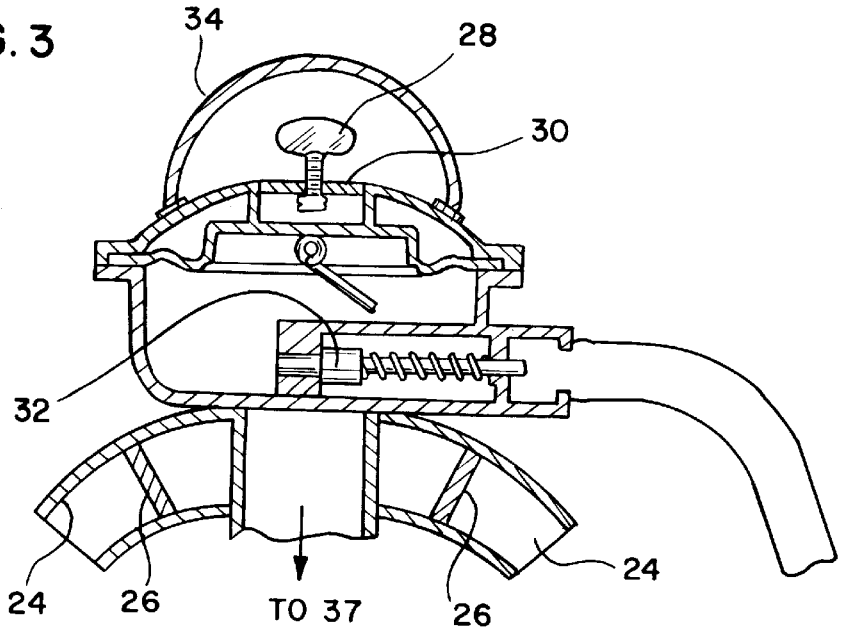
FIG. 3 is a drawing of the modified regulator which provides a supply of air or other breathable gas at no less than ambient pressure to the interior of the helmet.
Figure 4:
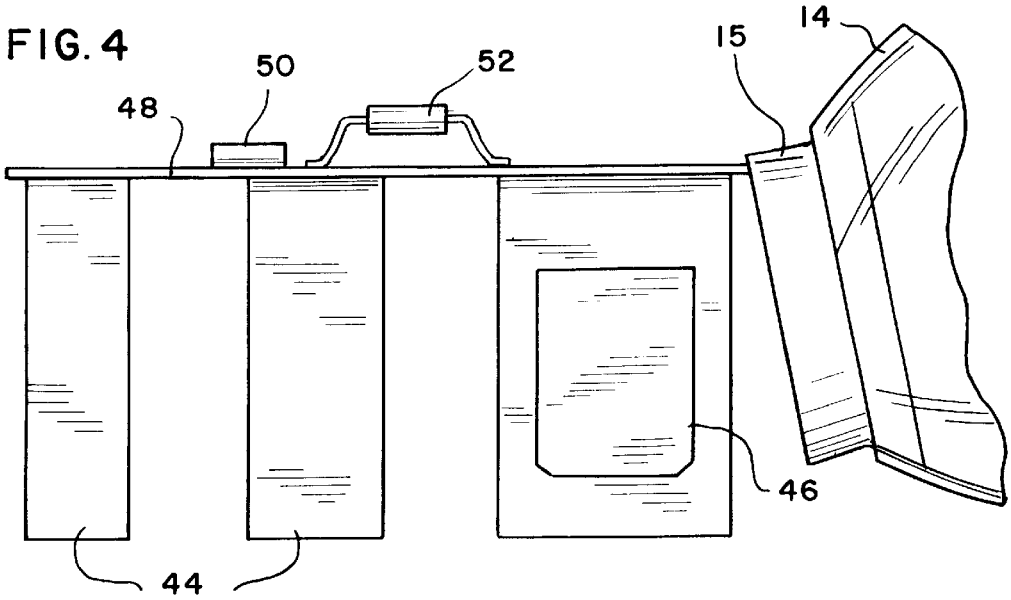
FIG. 4 is a drawing of the harness.

Regulator 18 is shown in FIG. 2 and in more detail in FIG. 3. A conventional Scuba second-stage regulator is modified in two ways. A description of a conventional second-stage regulator may be found at pages 61 and 62 of *Diving for Fun*, Joe Strykowski, and published by Dacor Corporation, Northfield, Ill. First, exhaust port 24, normally used by a human diver, is blocked by plate 26. Second, normal regulators do not provide air unless the user inhales. Regulator 18 has an adjusting screw 28 threadably engaged with a clearing button 30. Turning screw 28 causes it to bear against second stage air valve 32 causing it to remain open by an amount determined by the position of screw 28. Since valve 32 remains open, there is a small but constant flow of air from the air tank and its first-stage regulator, neither of which is shown here. Screw 28 is protected from accidental movement by a shroud 34, made from stainless steel.

Air delivered through valve 32 would normally be ported directly to the mouth of a human user. With modified regulator 18, however, air flows instead through a muffler 37 to port 36, which is connected to the interior of helmet 14. Port 36 is specially designed to induce a flow of air near the interior surface of helmet 14 and toward the front of the helmet. Experience has revealed that, without properly directed air flow, helmet 14 fogs, and interferes with good visibility. The shape of port 36 causes the flow of dry air (or any breathable gas) to follow the inner curvature of helmet 14, thus preventing fogging of helmet 14.

Figure 5:
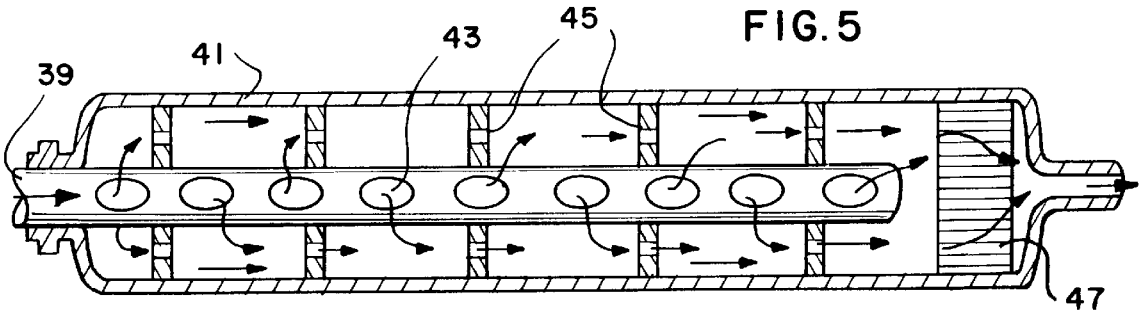
FIG. 5 is a drawing of the muffler.

Muffler 37 eliminates or reduces air noise caused by the constant flow of air into helmet 14. As shown in FIG. 5, muffler 37 receives air from regulator 18 and delivers it to port 36. Muffler 37 is comprised of two overlapping sections of hose 39 and 41. Hose 41 is also rubber, and is about one inch in diameter. Hose 39 is smaller than hose 41 and is connected to regulator 18. The portion of hose 39 that is inside hose 41 has a series of holes 43 that allow air to flow out of hose 39 and into the interior of hose 41, thus reducing the noise created by the flow of air. Holes 43 are one quarter-inch in diameter. The outlet of hose 41 is connected to port 36. Hose 39 is centered inside hose 41 by means of a series of plastic rings 45, which have holes in them to allow flow of air in the annular space between hoses 39 and 41 while still supporting and centering hose 39 inside hose 41. A stainless steel mesh screen 47 is located inside hose 41 and just prior to the outlet to port 36; screen 47 baffles the air and provides additional quieting.

Shadow inhales and exhales as necessary; slight excess pressure, typically about a few ounces per square inch, prevents water from leaking past skirt 15 into helmet 14. Shadow's exhalations flow out of the helmet through two exhaust ports 38, one on each side of the lower portion of helmet 14. Ports 38 are spaced about four and one-half inches apart to allow space for weight 20, and are located slightly above the bottom of skirt 15. Each of ports 38 is connected to a hose 40, described in more detail below.

As mentioned above, helmet 14 is attached to a harness 42. The harness must of course be adapted to the particular user. Nevertheless, several features are essential. Harness 42 can be constructed of the same strap material that is used for divers' weight belts. Harness 42 includes straps 44 with quick-release buckles for securing the harness around Shadow. Harness 42 has a pocket 46 on each side to receive and hold a weight to counteract Shadow's normal buoyancy. Pockets 46 are constructed with quick-release fastenings made of Velcro® or other suitable material, and can be made of strapping of a different color so that the weights can be removed quickly. The weights are coated with plastic and curved to fit Shadow's side comfortably.

The top of harness 42 has a central member 48 that is made of three layers of strapping material sewed together. The triple thickness protects Shadow's back and spine from the weight of an air tank, not shown, that can be attached to a a stainless steel saddle connector 50 on the central member 48. The triple thickness of central member 48 also provides additional rigidity to the combined assembly of helmet 14 and harness 42, thus preventing any buoyancy in helmet 14 from bending and placing stress on Shadow's neck. A handle 52 can be located on the member 48, preferably near the center of gravity of the apparatus. If desired, a flat stainless steel plate can be placed inside the sewed spine section to provide additional strength and stiffening. Harness 42 can also have a short line attached to the front of the harness; the line can be used as a guide or leash. In the present embodiment, a loop about three or four inches in size is used. A stainless steel saddle, not shown, can also be installed on the top spine section of harness 42 to support a separate air tank.

Breathable gas can be supplied to Shadow in two ways. One is by means of an air tank, not shown, attached to connector 50, with the first-stage regulator and an air guage nearer Shadow's tail, to keep them away from Shadow's other equipment. A conventional first-stage regulator, not shown here, is used to connect the high-pressure air in the bottle to the inlet of regulator 18. Shadow has used an aluminum tank having a capacity of ten or fifteen cubic feet; a tank will typically last for ten to twelve minutes in either a pool or the open ocean. Alternatively, air can be supplied from an air tank and first-stage regulator worn by a human diver, such as Dwane Folsom, Shadow's owner and trainer.

A means of removing Shadow's exhaled air is necessary. Helmet 14 includes two exhaust ports 38 as mentioned above. Locating the ports 38 low in the helmet assists in the removal of any residue water that might enter helmet 14 and otherwise collect there. As shown in FIGS. 1 and 2, each is connected to a hose 40. Spacing between the ports helps insure that they will function properly even if helmet 14 is tilted to one side due to Shadow's movement. The hoses 40 connect to a tee fitting 56 located above helmet 14, allowing the release of exhaled air. The length and diameter of hoses 40 is critical; improper selection of these parameters can lead to a "chimney" effect, where the hoses 14 draw air out of the helmet 14, thus interfering with the user's breathing by reducing the pressure in helmet 14. This problem may occur because the regulator 18 is above the helmet 14, the exhaust ports 38 are low, and the tee 56 is at roughly the same height as the regulator 18. The pressure in helmet 14 must be at least equal to or slightly higher than the pressure faced by air flowing out of tee 56; otherwise, there would not be any flow of air. A "chimney" or venturi effect in hoses 40 could reduce the pressure inside helmet 14 while still allowing enough of a pressure difference for flow to continue. Under those circumstances, helmet pressure could conceivably be reduced below the water pressure around Shadow's neck, which is normally below tee 56. Thus, water could leak into helmet 14 through opening 16.

Whatever the cause, experimentation has determined that a hose length of about fourteen and one-half inches with an internal diameter of three-quarters of an inch is effective. Tee 56 has two connections having a three-quarter-inch internal diameter to fit hoses 40. The third opening in tee 56 has a diameter of one inch. This configuration prevents any "chimney" effect.

Figure 6:
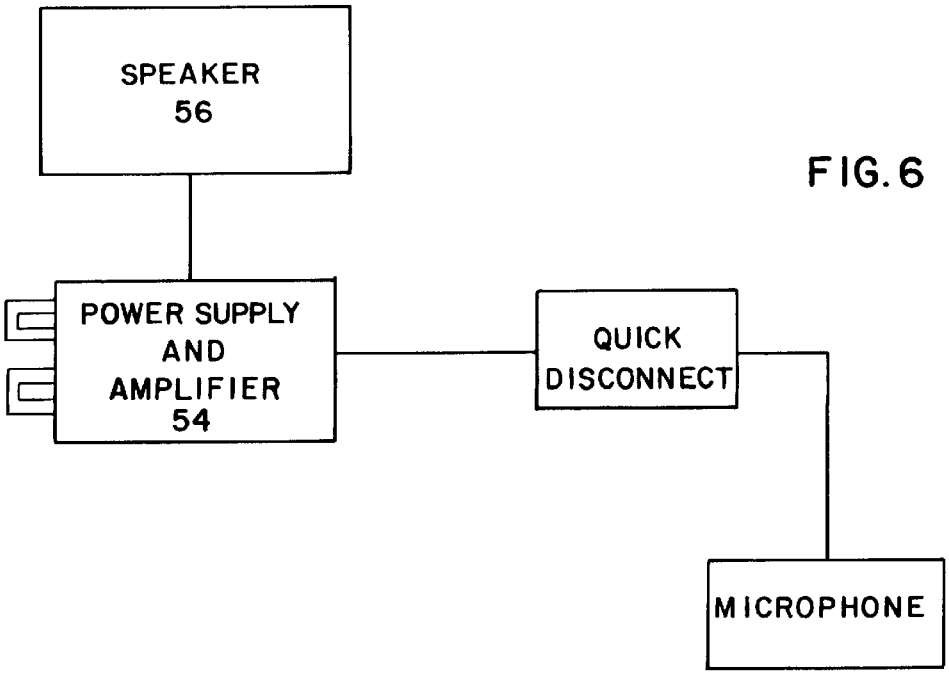
FIG. 6 is a block diagram of the intercom system.

The scuba apparatus can also include an intercom system, shown in a block diagram in FIG. 6. The intercom includes a power supply and amplifier 54 mounted inside helmet 14, a water-resistant speaker 57 mounted inside the helmet 14, and the necessary electrical connections. Power supply 54 is a water-resistant box 58 which contains a rechargeable nine-volt battery, an amplifier, and a magnetically-operated switch of any conventional type, all not shown. The switch can be actuated merely by placing a magnet in the proper place on the outside of box 58, thereby eliminating any need for the switch to penetrate the wall of box 58. Two terminals 62 project through the wall of box 58 and allow recharging of the battery. Terminals 62 are protected by plastic, non-conductive caps 64 and o-rings (not shown) when not in use. The caps insure that no electrically conductive path can exist between terminals 62; were a conductive path to exist, due perhaps to the presence of sea water, Shadow would be vulnerable to electrical shock. Both power supply 54 and speaker 57 can be attached to the interior of helmet 14 by any convenient means. In this embodiment, Velcro® fastening material is used since it allows easy removal and does not require the use of screws or other fasteners that might penetrate the wall of helmet 14. Speaker 57 is connected via a lead 66 which leaves helmet 14 through opening 16 and terminates in a watertight quick-disconnect fitting, not shown, secured to harness 42. A microphone lead for Shadow's handler, Dwane Folsom, is not shown here, but can be connected at the quick-disconnect fitting and terminates in a microphone mounted inside the regulator used by Dwane. He can use the microphone to give oral commands to Shadow at any time through speaker 57.

I claim:

1. An underwater self-contained breathing apparatus for use by a canine, comprising:

a transparent rigid helmet having a skirted opening for the wearer's neck, the helmet being sufficiently large to avoid contact with the face or nose of the canine user;

a regulator for supplying a breathable gas attached to the helmet;

a means of adjusting a position of a demand valve in the regulator to pressurize the helmet at no less than ambient pressure;

a harness attached to the helmet;

means for fastening the harness around the wearer's torso; and one or more pockets in the harness for receiving ballast weights.

2. The apparatus of claim 1 where the means for adjusting the position of the demand valve is a thumbscrew covered by a protective shroud.

3. The apparatus of claim 1 where the helmet further includes a means for receiving and securing an adjustable ballast weight inside the helmet, to compensate for moments created by the helmet about the canine user's center of gravity.

4. The apparatus of claim 1 further comprising two exhaust hoses each attached at its proximal end to a lower side of the helmet, and a length to diameter ratio of each hose is approximately eighteen to twenty.

5. The apparatus of claim 4 wherein the distal ends of the hoses are connected to two openings of a tee having an inlet diameter substantially the same as that of either hose, and an exhaust opening larger than either inlet.

6. The apparatus of claim 1 wherein the harness further includes a base for receiving a tank of breathable gas and straps for securing the tank to the harness.

7. The apparatus of claim 1 further comprising a muffler connected at a first end to an outlet of the regulator and at a second end to the interior of the helmet.

8. An underwater self-contained breathing apparatus for a canine comprising:

a transparent, rigid spherical helmet with a sealable opening surrounding the neck of a canine user, an of a sufficient size to avoid contact with the head or nose of the canine user;

a pressure reducing valve mounted on the outside of the helmet and having an inlet and an outlet, the outlet communicating through a muffler to the interior of the helmet;

a source of air communicating with the inlet of the pressure reducing valve;

a harness attached to the helmet and having straps and buckles for securing the harness to the torso of a canine user;

at least one pocket on the harness for receiving weight to compensate for the buoyancy of a canine user resulting from forces acting through the center of buoyancy of the canine user;

a ballast weight removably attached to the inside bottom surface of the helmet to compensate for any net moment about a center of buoyancy of the canine user resulting from forces acting other than through the center of buoyancy of the canine user;

a speaker and a microphone mounted inside the helmet;

an electrical connection from the speaker and microphone to a water-proof connector exterior to the helmet for connection to an intercom system;

a battery mounted inside the helmet to provide electrical power to the speaker and microphone; and a magnetically-operated switch to connect the power supply to the speaker and microphone.

* * * * *